United States Patent [19]

Morris

[11] 3,932,074

[45] Jan. 13, 1976

[54] SEAL FOR ROTARY FLUID-HANDLING APPARATUS

[76] Inventor: James C. Morris, 105 Beedle Circle, Pleasant Hills, Pa. 15236

[22] Filed: May 14, 1973

[21] Appl. No.: 359,785

[52] U.S. Cl. ..... 418/113; 418/225; 277/81

[51] Int. Cl.[2] ..... F16J 15/54

[58] Field of Search ..... 418/225, 120, 121–124, 418/113, 119 H; 277/81

*Primary Examiner*—Robert I. Smith

*Attorney, Agent, or Firm*—Cain and Lobo

[57] ABSTRACT

A seal for rotary pumps, engines, and the like, comprises roller means with variable effective length held in a variable-length supportive body or holder; extension cams maintain longitudinal tolerance of the roller means despite mechanical wear, machining imperfections and thermal expansion and contraction; wedge means maintain longitudinal tolerance of the holder. The seal is effective both at apex and corner areas of the rotary apparatus.

8 Claims, 8 Drawing Figures

SEAL FOR ROTARY FLUID-HANDLING APPARATUS

BACKGROUND OF THE INVENTION

1. Field of the Invention

This invention is in the field of seals for fluids; more particularly, the invention relates to seals for use in rotary pumps, engines, and the like.

2. Description of the Prior Art

Devices for handling fluids in various ways are known in the art, and are useful in many applications, such as in compressors, pumps, and external and internal combustion engines.

In recent years, rotary engines have been the subject of a great deal of engineering development. The most prominent among these is an internal-combustion engine commonly called the Wankel. This engine comprises a rotary member mounted on eccentric bearings, and operating in a trochoidal chamber. Rotation of the rotary member is kept in phase by the use of phasing gears, one of which is a stationary reaction gear fixed to the end cover plates mounted concentrically with the mainshaft.

Because of the simplicity of construction, the Wankel-type engine offers many advantages such as long life, low vibration, and high power-to-weight ratio. However, there are some problems with this engine which have persisted despite considerable effort spent on their solution. The principal one among these is that of seals in general, and apex and corner seals in particular.

The apex seal in a Wankel engine is generally a strip of material with a high hardness rating and/or a low friction value when used in the combustion chamber, where it rubs along the interior wall thereof. An example of such a material is graphite, suitably held by a metallic support, whereby both low friction and good material strength are provided, as described in U.S. Pat. No. 3,235,171. Many other materials have been used, among them high-chrome alloys, and the like.

Apex and corner seals serve the function of restricting fluid (gases in the case of rotary (Wankel) engines) to a particular portion of the apparatus. A considerable amount of effort has been expended in the attempt to provide such seals which will maintain a reasonably uniform and effective barrier to the working fluid, typically a gaseous mixture. One approach has been such as is described in U.S. Pat. No. 3,711,229 to Kurio, where the apex seal means is assisted by corner seals which are biased against the chamber wall by springs bearing on the rotary member.

Another problem common to seals for rotary engines, pumps, and the like, is the wear on the seal, which allows fluid or gas blow-by and lubricant leakage when it becomes extreme. This in itself would not be a severe drawback, assuming a reasonable life with respect to the running time of the engine or pump, since the problem of seal replacement is of the same approximate magnitude as that of ring replacement in a piston engine or compressor. However, one aspect of seal wear has been manifested in nonuniformity; that is, seals may wear in a fashion which permits the face or edge of the seal to conform to a shape different from the optimum configuration, which, in turn, may lead to pressure loss, excessive oil consumption, or both.

The problem of lubrication of seals of the type under discussion is an acute one, presenting considerations which must be taken into account when choosing a seal. Without any lubrication, of course, heat and friction would quickly destroy the seal and severely wear the chamber wall. Lubrication must be supplied, but it must be done in an economical manner, which is to say that a film of oil has to be present, but that a bath of oil would be wasteful.

Systems are known in this field which compensate for mechanical wear, such as by the use of wedge- or trapezoidal-shaped members, and the like, which displace longitudinally of the seal. There are also means for permitting a certain latitude in manufacturing tolerances. However, there have been no seal systems heretofore capable of compensating well for thermal expansion and contraction with their resulting unpredictable side effects. Necessarily, then, no seal system has yet been able to compensate for all of these variables.

With reference particularly to rotary-combustion engines, e.g., the Wankel, it is well-known among those skilled in the art that such engines can produce unacceptably high quantities of noxious emissions under various conditions which can occur readily due either to the construction or the operation of these engines. For example, if an apex seal is used which has gaps in the seal line, blow-by of unburned hydrocarbon results, and these materials then are emitted into the atmosphere unless some sort of post-combustion treatment is applied. Similarly, where gaps occur in the seal line or where the seal is worn from use, the leakage of hydrocarbon reduces combustion efficiency and temperature.

A further source of hydrocarbon emissions in some rotary-combustion engines is the use of oil-metering arrangements to provide lubrication to apex and corner seals. Because of the need to maintain a film of oil between the chamber wall and the seal, the oil must be supplied in appropriate fashion. In earlier designs, this was done by providing oil under pressure to the seal area itself; however, in most seal configurations, either geometry or economics dictate that the oil be supplied by admixture with the fuel. In these cases, some of the oil tends to be carried out unburned with the exhaust gases, obviously resulting in a detriment to the environment.

With all of the problems mentioned hereinabove, a concomitant effect is the lowering of the fuel economy of rotary-combustion engines below the optimum level otherwise possible. With improved seals, blow-by would be decreased, and over-all efficiency increased, leading then to improved fuel economy.

SUMMARY OF THE INVENTION

The present invention is the improvement in seals for rotary fluid-handling apparatus which comprises a two-part seal body with roller means at the tip. An extension cam in the roller means permits the roller means to expand and contract in response to wear and temperature changes without alteration in its diameter, and without introducing gaps in the sealing line. Means are provided to supply lubricant within and around the roller means. Extension means in the roller holder allows the holder to change length in cooperation with the roller means, thereby maintaining optimum tolerances despite wear, machining variations, or thermal contraction or expansion.

Thus, it is a general object of the present invention to provide a new and improved apex seal for rotary fluid-handling apparatus. It is another object of this invention to provide a new and improved apex seal for rotary fluid-handling apparatus which eliminates gaps in the sealing line. Further objects of this invention are: to provide a new and improved apex seal for rotary fluid-handling apparatus in which wear is constrained to a predictable and manageable pattern; to provide a new and improved apex seal for rotary fluid-handling apparatus which includes means providing an adequate and continuous supply of lubrication to the seal/rotor housing interface without the disadvantage of fuel and lubricant being mixed; to eliminate separate corner seals; to provide a new and improved pre-assembled seal for easy installation in rotary fluid-handling apparatus; to provide reduced leakage, reduced hydrocarbon emissions, and improved fuel economy in rotary-combustion engines by eliminating the loss of unburned gases into adjoining chambers; to provide new and improved apex and corner seals with means for automatic adjustment to compensate for wear, temperature and machining variations; and to reduce heat build-up in the seal to acceptable limits.

It is an object of this invention to obtain one or more of the objects set forth above. These and other objects and advantages of this invention will become apparent to those skilled in the art from the following specification and claims, reference being had to the attached drawings.

FIGS. *3a* and *3b* are a perspective view of the extension cams.

Figure 2:
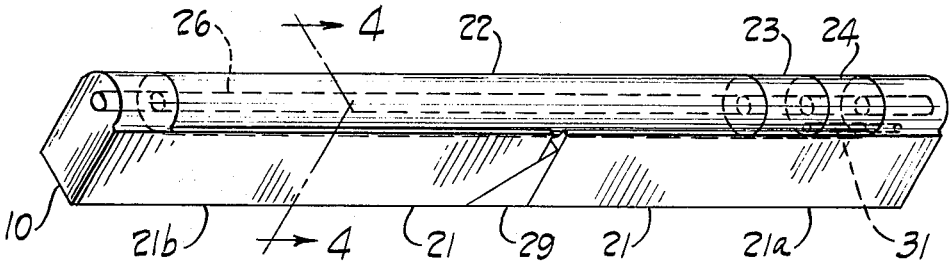
FIG. 2 is a view in perspective of the roller-seal apparatus of this invention.

FIG. *4a* is a section along lines 4—4 of FIG. 2 showing an embodiment of the invention where the roller is retained in the holder by means of a pin.

FIG. *4b* shows another embodiment of the invention where the holder extends more than halfway around the circumference of the roller.

Figure 5:
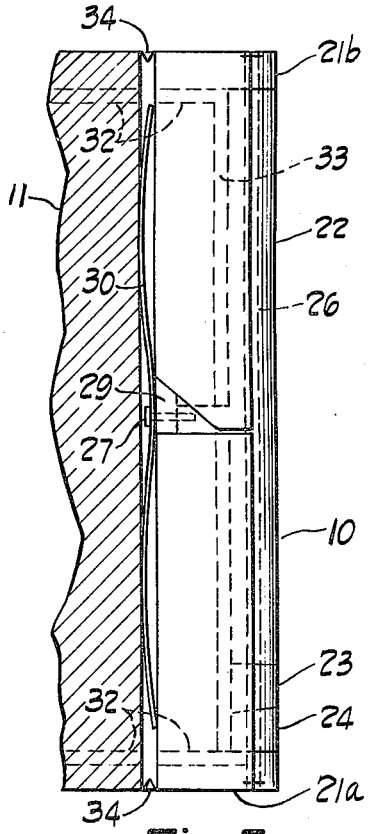

FIG. 5 shows a pre-assembled roller-seal apparatus.

Figure 6:
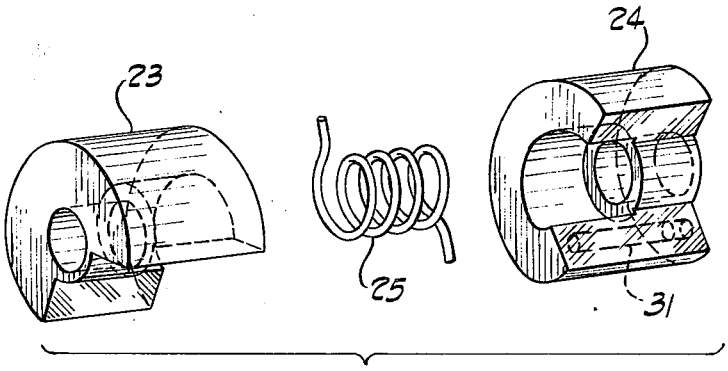

FIG. 6 is an exploded view of the extension cams, showing spring means for providing the extending force.

DESCRIPTION OF THE PREFERRED EMBODIMENTS

Figure 1:
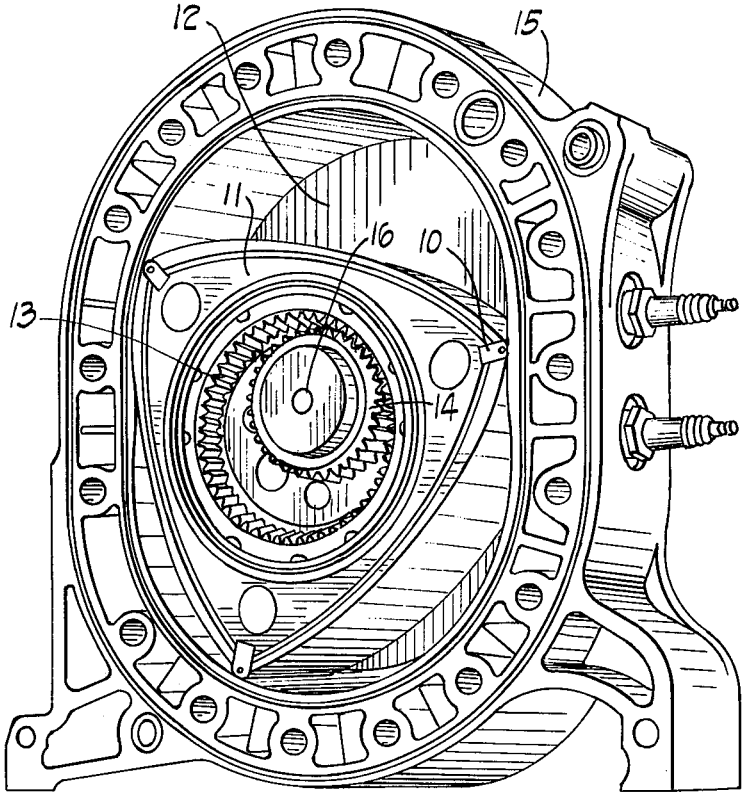
FIG. 1 shows one embodiment of the invention as the apex seal in a rotary combustion engine.

The present invention will be understood by those skilled in the art by reference to FIG. 1, which is a view in perspective of one embodiment of the present invention installed in, e.g., a rotary combustion engine 15. The seal 10 of the present invention is shown at the apex of the rotary member 11, disposed within combustion chamber 12.

In the operation of the rotary combustion engine shown, expanding gases from the burning of petroleum fuel cause the rotary member 11 to turn due to the pressure generated within the space defined by the wall of combustion chamber 12 and a face of the rotary member 11.

By the reaction of internal gear 13, fixed to the rotary member 11, and external gear 14, fixed to the housing, force is transmitted through eccentric 16 to the output shaft.

As the rotary member 11 turns, the unburned mixture and exhaust gases are separated by apex seals 10, which move around the interior surface of combustion chamber 12. In the prior art, as heretofore described, such seals moved slideably along that surface. While such seals worked acceptably, it is clear that a rolling seal would inherently be less susceptible to mechanical wear.

In the description of the present invention, the term "roller means" is used to describe the apex-seal line generally, while "roller" is used for that part of the seal which is freely rotatable.

As shown in FIG. 2, where 10 is the roller seal generally, the support body, or holder 21, maintains roller 22 rotatably disposed therein, the roller being held in axial alignment by axis pin 26. Extension cams 23 and 24 are also disposed on axis pin 26; however, the extension cams are movable only with respect to each other, and are restrained to rotate less than 360° on axis pin 26; further rotation would cause them to drop back to a position of least extension. The rotation of cam 24 is restrained by cam-orientation pin 31, and the rotation of cam 23 is restrained by its ability to move only far enough to cause roller 22 to bear against the end of holder 21. Spring means 25, shown more clearly in FIG. 6, disposed on axis pin 26, operates to urge cams 23 and 24 in rotatably opposite directions; due to the ramp faces of the cams, the effect is to extend the distance between the lower parallel face of cam 24 and the upper parallel face of cam 23, while obviating any gap between the cams at the seal line. By the construction of the roller seal, when the parallel faces of cams 23 and 24 are as close together as possible, the roller means is at its shortest length. When cam 23 has rotated to its most fully extended position relative to cam 24, but less than 360°, roller 22 is urged against holder 21, and the roller means is at its greatest length. See FIGS. *3a* and *3b*. The net effect of the operation of the extension cams 23 and 24, then, is to provide a sector of a cylinder whose length is variable within limits, and whose radius is fixed at all points on that sector. In this manner, a variable-length seal without gaps is presented to the wall of the chamber 12 in FIG. 1 in which the rotary member 11 moves. Since the major portion of the seal is rotating, wear is substantially decreased below what would occur with a sliding seal.

Another advantage in a seal with a circular cross-section is that the seal-wall contact is always the same; thus, no considerations of contact angle arise, and sealing is uniform without regard to chamber eccentricity.

Axis pin 26 holds the roller 22 and cams 23 and 24 in such relationship with holder 21 that a thin film of oil is maintained by capillary action therebetween, as more fully described hereinbelow, providing a lubricating capability in the seal.

Referring now to FIGS. *3a* and *3b*, the extension cams 23 and 24 are shown assembled with spring means 25. The action of the spring or the operation of roller 22 and holder 21 urges cam 23 to move in relation to cam 24 by slideably rotating, the ramp surfaces thereof causing the upper face of cam 23 and the lower face of cam 24 to move closer together or farther apart while maintaining a parallel relationship. Referring back briefly to FIG. 2, it will be seen that the movement of cam 23 is limited by the position of roller 22; this provides a compensation for wear in roller 22. As the roller wears at either or both ends, it becomes shorter; similarly, as holder 21 wears at the ends thereof, the space in which the roller can move increases, and cam 23 automatically follows the variation in length. Conversely, in a moving apparatus which becomes warm through frictional or combustion energy, or the like, roller 22 expands against cam 23, forcing it part way down the ramps on both cams 23 and 24. Thus, the seal is maintained at full effective length. In the embodiment shown in FIG. 2, cam-orientation pin 31 holds cam 24 in fixed relationship to holder 21.

Figure 4A:
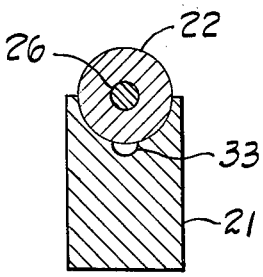

In FIG. 4*a*, the roller-retention means described in FIG. 2 is shown in cross-section. Here, axis pin 26, which can be integral with the holder 21, holds roller 22 in rotatable relationship with the holder body 21. The spacing is chosen such that lubricant used to minimize friction will tend to remain in the space between roller 22 and the holder 21, and between axis pin 26 and the roller 22, even in the absence of lubricant feed supply. In this fashion, lubricant will tend to remain in the seal parts when the apparatus is at rest, and will not drain off. In addition to reducing wear in start-up, this feature also reduces the tendency for component parts to oxidize during periods when the apparatus is not in use.

Figure 4B:
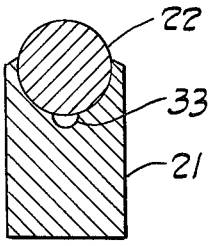

FIG. 4*b* shows another method for holding the roller and extension cams in position. In this sectional view, the holder 21 partially surrounds roller 22, and cams 23 and 24, in the same spatial relationship as described with respect to FIG. 4*a*.

As shown in FIG. 5, wedge 29 is held by the pressure of spring 30 in the space between tongue end 21*a* of the roller holder 21, and groove end 21*b* thereof. Lubricant such as, e.g., hydrocarbon oil, is circulated by pump means, not shown, from rotary member 11 through orifices 32, and is conducted through the seal mechanism by channels 33. In this embodiment, oil seals 34 retain the lubricant within the region bounded by the rotary member and the rotary seal apparatus.

Closely allied to the lubrication problem is the problem of heat build-up. Although sufficient lubrication will reduce the amount of heat generated by friction, it will have little effect upon the heat absorbed from the working fluid (combustion gases in the case of rotary engines).

The common method of dealing with this accumulated heat is to fashion the apex seal means from a material which will perform satisfactory at high temperatures. These high temperatures, however, produce adverse side effects, including rapid degeneration of lubricants and thermal expansion.

A further consideration of FIG. 5 discloses that the present invention is useful in providing additional cooling for the apparatus in which it is used. By pumping oil into channel 33 behind roller 22, two functions are accomplished: a thin film of oil is maintained on the roller, to keep friction and wear to a minimum, and the oil which circulates through the channel carries away waste heat from the operation of the apparatus. As an added effect, the thin film of oil on the roller is transferred to the wall of chamber 12.

Figure 3A:
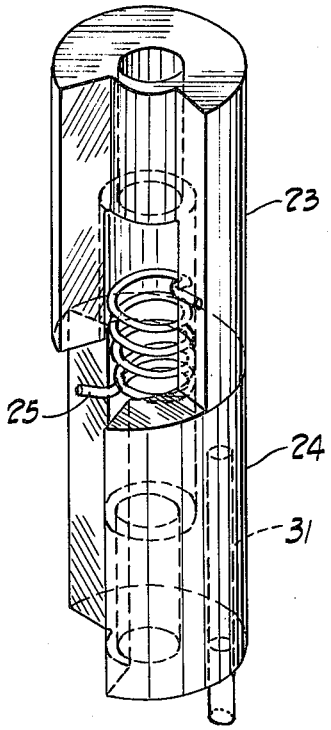
Figure 3B:
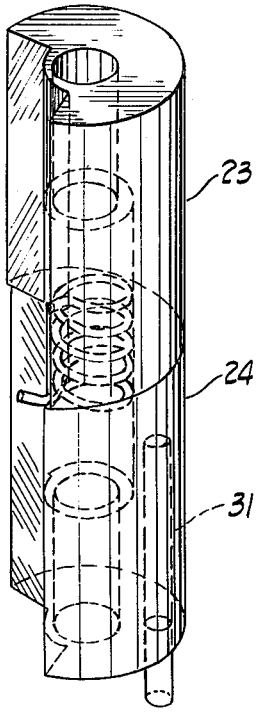

Referring again to FIG. 1, where the roller seal 10 is shown mounted in rotary member 11, it will be observed that wear on the seals comprises both apex and corner wear; i.e., the seal wears at the face, or edge, and at the ends. Thus, as shown by FIGS. 2 and 3, wedge 29 serves to maintain a constant effective length of the holder 21, while extension cams 23 and 24 hold roller 22 at a similar constant effective length. In operation over extended periods, even though roller 22 (and holder 21) may wear at the ends thereof, optimum tolerances are maintained by the virtually automatic action of extension cams 23 and 24. The holder 21 may likewise vary in effective length due to the virtually automatic action of the extension cams 23 and 24. Similarly, frictional wear of the holder 21 on the chamber side walls is compensated by wedge 29. In this fashion, the entire assembly keeps very close to its original dimensions throughout the life of the seal. The same analysis obtains with respect to the holder 21 as it bears on the face of chamber 12.

It will be further appreciated from a consideration of the drawings that roller 22 will retain an essentially circular cross-section, and will wear slowly, because of the low-friction rolling contact with the wall; other portions of the seal will bear against the wall only as the roller wears and permits them so to bear.

Thus, a constant wear pattern is imposed upon the various parts of the seal, and the seal will maintain approximately the same configuration throughout its life. It will in this manner adapt to variations in apparatus tolerances, operating temperatures, machining finishes, and the like. In summarizing this aspect of the invention, it should be noted that the portion of the roller seal mechanism with the greatest area, the roller, preferably has the highest hardness; that portion with a smaller area, the holder, requires a softer material, and the cams, having the greatest need to conform as they wear, should be the softest of the three.

By constructing the seal apparatus of the present invention with different hardness ratings of the various component parts thereof, the capability of uniform wear patterns is enhanced. Thus, if the roller is fabricated from a harder material than the holder, which, in turn, is harder than the cams, the wear pattern of the holder and cams will be effectively forced to follow that of the roller. The mechanism of this may be explained in the following fashion. With cams of an initial size slightly larger than the diameter of the roller, for instance, the initial wear will be only on the cam, since the roller cannot bear on the wall surface. When the cams have worn down to the size of the roller, then the roller begins to bear on the chamber wall; the wear on the roller then begins, but proceeds only until the roller, cams and holder are bearing on the wall equally.

A lower-cost construction of rotary fluid-handling devices than heretofore possible is made feasible because the chamber wall does not need to be hard-surfaced in the operation of the present invention. In fact, the chamber wall can be slightly softer than the roller, but somewhat harder than the holder, which, in turn, can be slightly harder than the cams. By the mechanism described above, the wear on the walls will be optimum, and the seal mechanism will wear uniformly and with relative slowness. This aspect of the present invention permits a wider choice in materials and methods of manufacture than heretofore possible.

It is also feasible in the operation of this invention to use materials which are self-lubricating, thereby eliminating or reducing the problems attendant upon supplying lubricant to moving parts, described hereinabove.

The embodiment shown in FIG. 5 permits the seal to be installed as a unit, rather than as individual pieces. In this embodiment, the two portions of holder 21 are movably held together by pin 26 extending the length of the seal, through roller 22 and cams 23 and 24. Wedge 29 is affixed to spring 30 by appropriate means such as, e.g., a post 27 movably attached to wedge 29 through spring 30, and pressed or otherwise held in holder 21 in such fashion as to permit relative movement of wedge 29 and holder 21. These pieces are also fastened in a manner to prevent any of the constituent parts of the seal mechanism from coming loose, such as peening the ends of pin 26, which is shortened slightly to fit the recessed ends of holder 21. Oil seals 34 can be optionally affixed either to the rotary member 11 or to the assembled rotary seal unit 10. This unitary assembly, applied in the case of, e.g., a Wankel engine, makes seal replacement a simple task by eliminating the need for handling multiple parts.

Those skilled in the art will note that many variations are possible in the construction of the roller seal of this invention without departing from the scope or spirit thereof. For example, cam 24 could be fashioned as an integral part of holder 21; holder 21 could comprise only two pieces, with angled mating surfaces to provide both sealing and extension capabilities, or on the other hand, could be assembled from separate end pieces, body portions and a plurality of extending wedges. Further, the holder could be adapted to maintain an appropriate length by fluid pressure, as could the extension cams. Axis pin 26 could be integral with roller 22, being adapted to permit the seal to change in length as already described, and the holder could also be provided with extension cams to permit variable length.

It will be noted that a differential wear pattern is possible on the walls of the chamber where the edge or face of the seal bears, due to the fact that one part is rolling while another part is sliding. Even though such a differential would be small, as explained hereinabove, it can be minimized further by installing at least one of the seals the reverse of the others. That is, if the cams on one or more the seals are on the right side of the rotary member, the other seal or seals should be installed with the cams on the opposite side. This feature is a further improvement over the prior art, where existing seals must be replaced not only in the same attitude, but in the same order.

It will be obvious to those skilled in the art that the construction and operation of the present invention will permit the rotary-combustion engines as hereinbefore described to operate with improved efficiency, due to reduced internal friction, improved sealing, and the resultant segregation of burned and unburned gases into their respective portions of the engine chamber. Thus, fuel economy is improved, and deleterious emissions into the atmosphere are reduced.

Modifications, changes, and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited by the advance of which the invention has promoted the art.

What is claimed is:

1. A seal for fluid-handling apparatus, said seal comprising a holder, and roller means rotatably disposed in said holder, said holder being adapted to vary automatically in effective length, and said roller means including at least one extension cam disposed to rotate less than 360° with respect to its most fully extended position to vary the effective length of said roller means.

2. The seal according to claim 1 in which one said extrusion cam includes a first ramp surface, said roller means includes a second ramp surface complementary to and engaging one said cam ramp surface, and said first and second ramp surfaces have relative rotational movement with respect to each to vary the effective length of said roller means.

3. The seal of claim 2 wherein at least one of said surfaces is integral with said holder.

4. The seal according to claim 2, including spring means urging said one extension cam to rotate said first cam ramp surface relative to said second ramp surface to extend the effective length of said roller means.

5. The seal according to claim 2 including a second said extension cam, said second ramp surface being disposed on said second extension cam.

6. The seal according to claim 5 wherein said one and second extension cams are urged to rotate to provide maximum length of said roller means by spring means interposed cooperatively between said one and second extension cams.

7. In apparatus for handling fluids, having a chamber, a rotating internal member, means for admitting and removing fluid, and a plurality of seal means, an improvement in the said seal means comprising a holder, and roller means rotatable disposed in said holder, said holder comprising at least two pieces, said holder being extensible axially to vary in effective transverse length, said roller means comprising first and second complementary, mutually engaging ramp surfaces disposed to rotate with respect to one another less than 360° relative to their most fully extended position to extend said roller means axially to vary in effective transverse length in cooperation and conformance with said holder.

8. The apparatus of claim 7 wherein said each said ramp surface is carried on an extension cam, and said cams are disposed to rotate with respect to one another less than 360°.

* * * * *